United States Patent [19]

Lance

[11] Patent Number: 4,558,522

[45] Date of Patent: Dec. 17, 1985

[54] HAND GUIDE FOR PAINTERS OR DRAFTSMEN

[76] Inventor: Marcel Lance, 100 route de la Badine, 06160 Juan Les Pins, France

[21] Appl. No.: 577,745

[22] Filed: Feb. 7, 1984

[30] Foreign Application Priority Data

Feb. 7, 1983 [FR] France ..... 83 02011

[51] Int. Cl.[4] ..... A47B 97/04

[52] U.S. Cl. ..... 33/443; 33/1 K; 248/449

[58] Field of Search ..... 33/430, 443, 444, 445, 33/1 K; 248/448, 118.5, 449, 118.3

[56] References Cited

U.S. PATENT DOCUMENTS

| | | | |
|---|---|---|---|
| 2,496,276 | 2/1950 | Dolas . | |
| 3,226,077 | 12/1965 | Killen | 248/448 |
| 4,088,290 | 5/1978 | Novello . | |
| 4,109,892 | 8/1978 | Hartung | 248/449 |
| 4,134,614 | 1/1979 | Fielding, Sr. . | |

FOREIGN PATENT DOCUMENTS 61454 3/1892 Fed. Rep. of Germany .

*Primary Examiner*—William D. Martin, Jr.
*Attorney, Agent, or Firm*—Young & Thompson

[57] ABSTRACT

A removable handguide for painters or draftsman, adapted to be secured on an easel, and comprising a frame constituted by an upper crosspiece, a lower crosspiece, and two uprights, and at least one horizontal bearing bar slidably mounted on the uprights. At least the upper and lower crosspieces are each comprised by two separate half crosspieces, and a sliding member slidably mounted on the half crosspieces allows the adjustment of at least the width of the frame to the dimensions of a panel to be painted. The horizontal bearing bar has two legs each of which is provided at its free end with locking structure for locking the bearing bar along the uprights and each of which legs is secured by hinges to a sliding member slidably mounted on the uprights. The locking structure is preferably comprised by ferrules made of a material which is highly resistant to sliding, thereby preventing sliding of the bearing bar along the uprights when the bearing bar is in service position.

4 Claims, 3 Drawing Figures

HAND GUIDE FOR PAINTERS OR DRAFTSMEN

The invention has for its object a hand guide for painters or draftsmen.

At present, painters or draftsmen use as hand guides a wand, usually of wood, whose one end comprises a thick ball, which is pear-shaped, protected by leather or cloth. The painter applies the ball of the wand against the canvas, panel or other support for his work, and he supports one hand on said wand and ultimately rests the other hand on it to continue his drawing; each time he moves his hand, he moves the wand which serves as the hand guide and is careful not to put it into contact with the paint that is not yet dry.

The invention avoids these drawbacks. The invention permits choosing exactly the position in which the painter wishes to work without having to consider whether the paint is dry or not, because the hand guide according to the invention does not bear on the canvas or panel.

The hand guide according to the invention is composed of a frame which is emplaced about the panel to be painted by securement means, said frame comprising adjustment means of its width and/or of its height, and this as a function of the dimensions of said panel; at least one means serving as a bearing bar is mounted slidably on the uprights of the frame, locking means permitting locking said bearing bar along the uprights of said frame, at the desired height at the level of the panel.

The securement means for the frame about the panel may be means such as clamps or hooks which can be secured to the easel. These means are not shown in the drawings.

The adjustment means of the width and height of the frame as a function of the dimensions of the panel are tubes or telescoping or sliding rods, which thus permit varying the dimensions of said frame.

The bearing bar is slidably mounted on the uprights of said frame, the locking means consisting in that said bar forms a U whose legs are secured, by means of a hinge, to the member which slides along the upright.

The locking means may be a screw or a nut which prevents the movement of said member along the upright. The locking means may also consist in that the ends of the legs of the U comprise a material which offers high resistance to movement, such as rubber. In this case, the ends of the bearing bar each have a ferrule.

In the position of use, the ends of the bar rest on the uprights and the bar accordingly cannot slide along said uprights because the ends provided with their ferrules brake all displacement.

The accompanying drawings, given by way of illustrative but non-limiting example, permit easy understanding of the invention; they show a preferred embodiment according to the invention.

Figure 1:
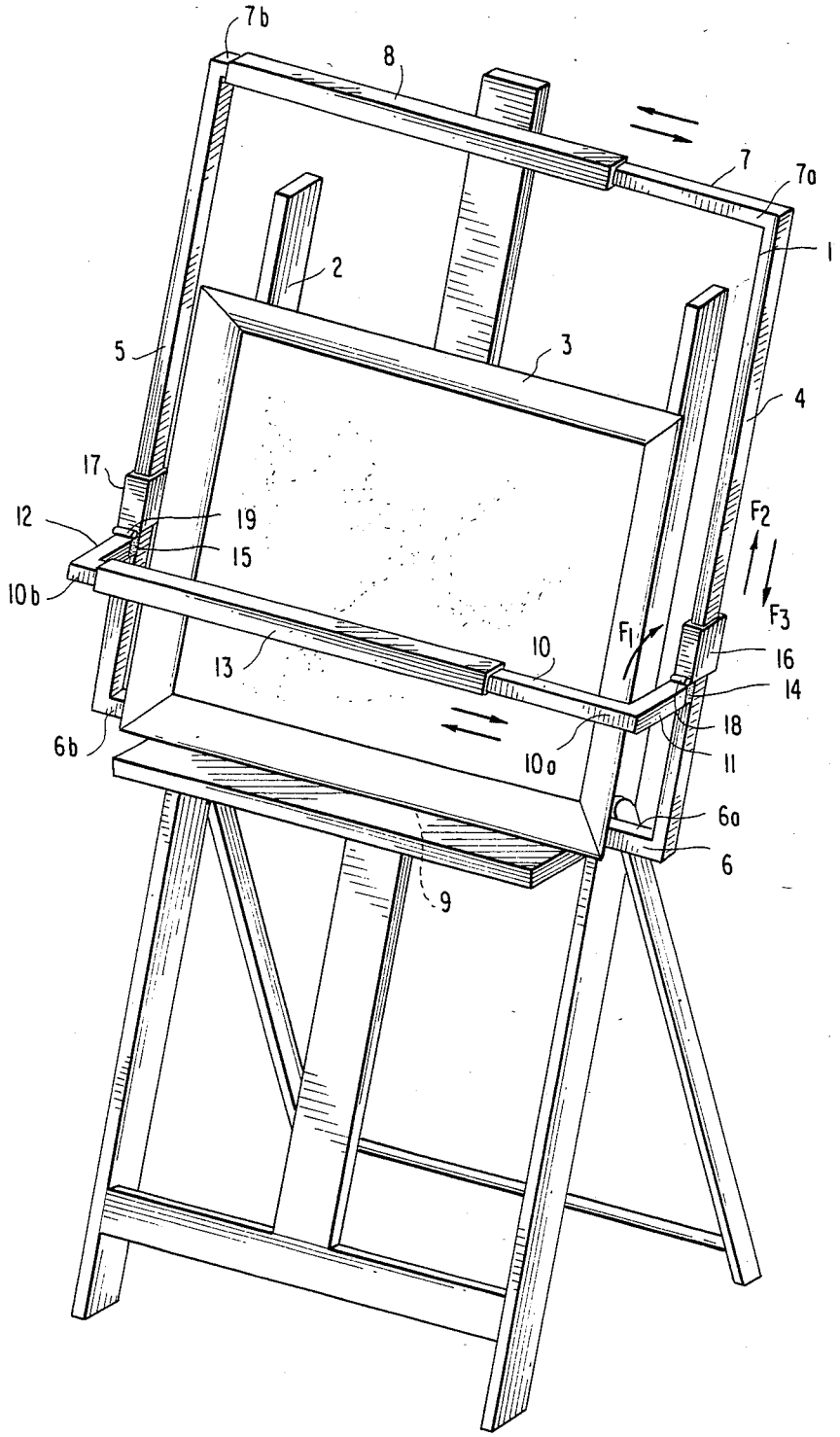
FIG. 1 is a perspective view of the hand guide according to the invention mounted on an easel.
Figure 2:
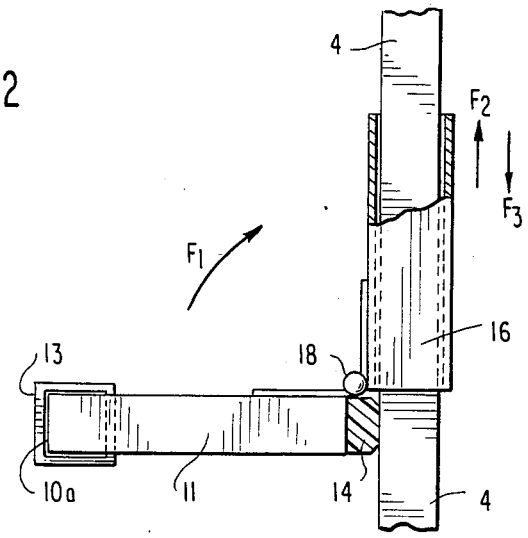
FIG. 2 is a cross-sectional view at the level of an upright of the frame of the hand guide and of the bearing bar.
Figure 3:
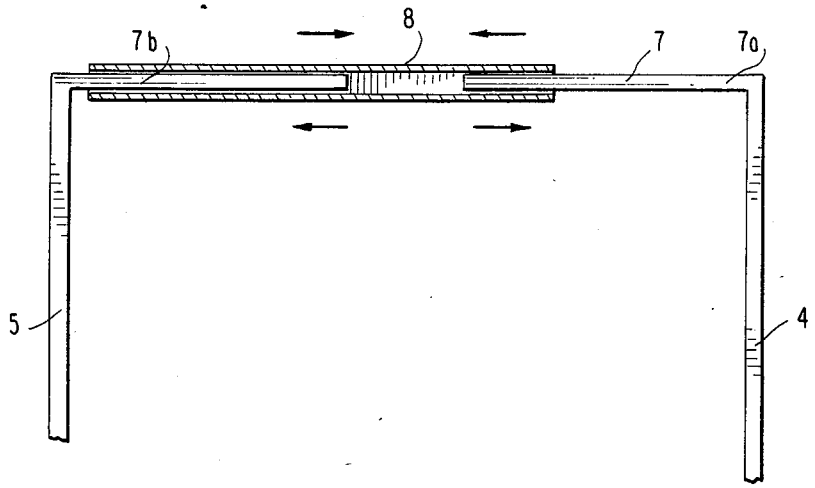
FIG. 3 is a detailed cross-sectional view of means permitting modifying the width of the frame as a function of the dimensions of the panel to be painted.

Said hand guide according to the invention is comprised by a frame 1 which is adapted to be emplaced on an easel 2 about a panel 3 to be painted. The frame 1 is comprised by two uprights 4 and 5 and two crosspiece

6 and 7—a lower crosspiece 6 and an upper crosspiece 7.

The crosspieces 6, 7 are interrupted at their middle and a sliding member 9 receives the two lower half crosspieces *6a*, *6b* and a like sliding member 8 receives the two ends *7a*, *7b* of the two upper half crosspieces. Thus, the frame 1 may be adapted as to width to the dimensions of the panel 3 to be painted. It is possible to provide that the uprights 4 and 5 be also each divided in two parts and that a slidable member can receive the two half uprights. This embodiment is not shown on the figures.

The bearing bar 10 which permits guiding the hand is of U-shape, it is interrupted at its middle to comprise two half bearing bars **10*a*, 10*b* and a sliding member 13 receives its two half bearing bars 10*a*, 10*b* so as to permit, as also for the crosspieces 6 and 7, adjustment of the width as a function of the dimensions of the panel 3** to be painted.

The ends of legs 11 and 12 of the bearing bar 10 comprise ferrules 14 and 15, for example of rubber or any other material having great resistance to sliding, which brake and retard any sliding of the bearing bar 10 along the uprights 4 and 5. These same ends of the legs 11 and 12 are connected to sliding pieces 16 and 17, mounted on the uprights 4 and 5, by hinges 18 and 19. Thus, it suffices to raise said bearing bar in the direction of the arrow $F_1$ to be able to move it upwardly and downwardly in the direction of the arrows $F_2$ or $F_3$. As soon as the bearing bar 10 is raised, the legs 11 and 12 no longer rest on the uprights 4 and 5, and the ferrules 14 and 15, of rubber or plastic, therefore do not brake the displacement along the uprights 4 and 5.

I claim:

1. Removable hand guide for painters or draftsmen adapted to be secured to an easel, said hand guide comprising a frame constituted by an upper crosspiece, a lower crosspiece and two uprights and at least one horizontal bearing bar slightly mounted on said uprights, at least said upper crosspiece and said lower crosspiece each being comprised by two separate partial crosspiece slidably interconnected so as to allow the adjustment of at least the width of the frame to the dimensions of a panel to be painted, said horizontal bearing bar being adjustable as to length and comprising two legs each of which is provided at its free end with locking means for locking said bearing bar along said uprights and each of which legs is secured by means of hinges to a sliding member slidably mounted on said uprights.

2. Hand guide as in claim 1, wherein said locking means are comprised by members made of a high friction material, the last-named members being carried by said legs and bearing against said uprights when downward force is exerted on said bearing bar, thereby preventing undesired downward sliding of said bearing bar along said uprights when said bearing bar is in service position.

3. Removable handguide for painters or draftsmen adapted to be secured to an easel, said handguide comprising a frame constituted by an upper crosspiece, a lower crosspiece and two uprights and at least one horizontal bearing bar slidably mounted on said uprights, said horizontal bearing bar comprising two legs each of which is provided at its free end with locking means for locking said bearing bar along said uprights and each of which legs is secured by means of hinges to a sliding member slidably mounted on said uprights.

4. Handguide as claimed in claim 3, wherein said locking means are comprised by members made of a high friction material, the last-named members being carried by said legs and bearing against said uprights when downward force is exerted on said bearing bar, thereby preventing undesired downward sliding of said bearing bar along said uprights when said bearing bar is in service position.

* * * * *